US006203341B1

(12) United States Patent
Chen

(10) Patent No.: US 6,203,341 B1
(45) Date of Patent: Mar. 20, 2001

(54) CABLE CONNECTOR

(75) Inventor: Denis Chen, Kun-San (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/421,436

(22) Filed: Oct. 19, 1999

(30) Foreign Application Priority Data

Aug. 17, 1999 (CH) ..... 088213958

(51) Int. Cl.[7] ..... H01R 13/53
(52) U.S. Cl. ..... 439/186; 439/362; 439/901
(58) Field of Search ..... 439/181, 186, 439/610, 362, 901

(56) References Cited

U.S. PATENT DOCUMENTS 5,342,216 * 8/1994 Davis et al. ..... 439/362
5,989,051 * 11/1999 Zelno et al. ..... 439/362

* cited by examiner

*Primary Examiner*—Gary F. Paumen
(74) *Attorney, Agent, or Firm*—Wei Te Chung

(57) ABSTRACT

A cable connector of the present invention comprises an insulative housing, a number of conductive contacts, a pair of positioning levers and an insulative shell. The insulative housing has a mating face on a front end for mating with a mating connector and receives a mating portion of the conductive contacts therein. A metal shield is fitted to the front end of the insulative housing, thereby enclosing the mating portion of the conductive contacts. The pair of the positioning levers extends through respective holes defined in opposite sides of the insulative housing and each defines a retaining portion which extends beyond the mating face of the insulative housing for securely engaging with a mating connector. The insulative shell encloses the retaining portions of the pair of the positioning levers and the metal shield, thereby guarding electronic components near the cable connector from accidental electrostatic discharge.

1 Claim, 4 Drawing Sheets

CABLE CONNECTOR

BACKGROUND OF THE INVENTION

The present invention relates to a cable connector, and particularly to a cable connector which protects connected equipment from electrostatic discharge from the cable connector.

Refer to prior art Taiwan Patent Application Nos. 83209871, 83304986 and 84207854. FIG. 4 shows a top view of a prior art cable connector. A pair of positioning levers 6 extend through a pair of holes defined on opposite sides of a housing. The lever 6 comprises a retaining portion (not shown) at a lower end and a handle 62 at an upper end. The retaining portion defines a threaded periphery 611 at a free end extending through the hole in the housing. The cable connector is fixed to a mated connector (not shown) by rotating the handle 62. However, with the trend toward a higher density of electronic components mounted on a printed circuit board, the distance between adjacent electronic components is shorter and shorter, so the threaded periphery 611 of the retaining portion of the lever 6 may easily contact other electronic components during mating. Thus, the static electricity collected on the positioning lever 6 may discharge through the threaded periphery 611, damaging the electric components contacted by the threaded periphery 611.

BRIEF SUMMARY OF THE INVENTION

An object of the present invention is to provide a cable connector which has an insulative shell at a proper position to protect other components from being damaged by electrostatic discharge when coupling or uncoupling the cable connector to a printed circuit board.

The cable connector of the present invention comprises an insulative housing, a plurality of conductive contacts and an insulative shell. The insulative housing has a mating surface at a front end. Each of the conductive contacts defines a mating portion received in an insulative terminal housing depending forward from the mating surface of the insulative housing. A metal shield is fitted to the mating face of the insulative housing, surrounding the insulative terminal housing. A pair of levers each form a retaining portion at one end and a handle on the other end. The pair of levers extend through a pair of through holes defined in opposite sides of the insulative housing and the retaining portions thereof extend beyond the mating face of the insulative housing at opposite sides of the metal shield. The insulative shell is engaged with the front end of the insulative housing and encloses the metal shield and the retaining portions of the two levers therein, thereby guarding elements mounted on a printed circuit board from accidental contact with the retaining portion thereof or the metal shield, protecting said elements from electrostatic discharge.

DETAILED DESCRIPTION OF THE INVENTION

Figure 1:
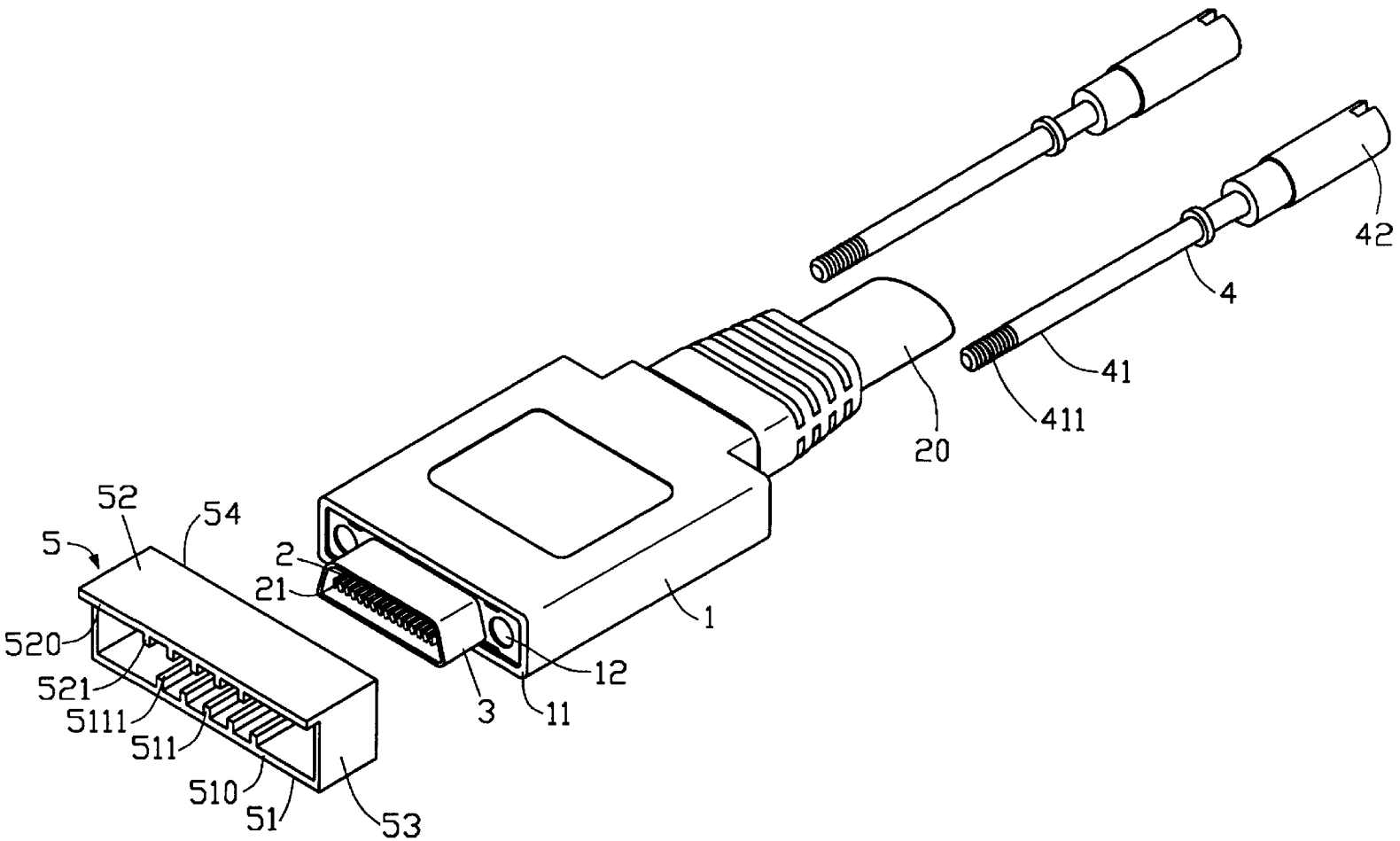
FIG. 1 is a partially assembled perspective view of a cable connector of the present invention.

Referring to FIG. 1, a cable connector of the present invention comprises an insulative housing 1, a plurality of conductive contacts 2, a pair of positioning levers 4 and an insulative shell 5.

The insulative housing 1 is substantially rectangular in shape and comprises a conductive mating face 11 on a front side thereof, a metal shield 3 depending in a forward direction therefrom and surrounding the forward end of an insulative terminal housing 14. A pair of through holes (not labeled) corresponding to the pair of positioning levers 4 extend through the insulative housing 1 from a front face thereof to an opposite rear face on opposite sides of the metal shield 3. A corresponding pair of holes 12 is defined in the mating face 11 of the insulative housing 1.

The plurality of contacts 2 each form a mating portion 21 on one end and a mounting portion (not shown) on the other end. The mating portion 21 thereof is received in the insulative terminal housing 14.

The pair of positioning levers 4 each comprise a handle 42 on a rearward end and a retaining portion 41 at a forward end. The retaining portion 41 defines a threaded periphery 411 at a foremost end thereof.

Figure 3:
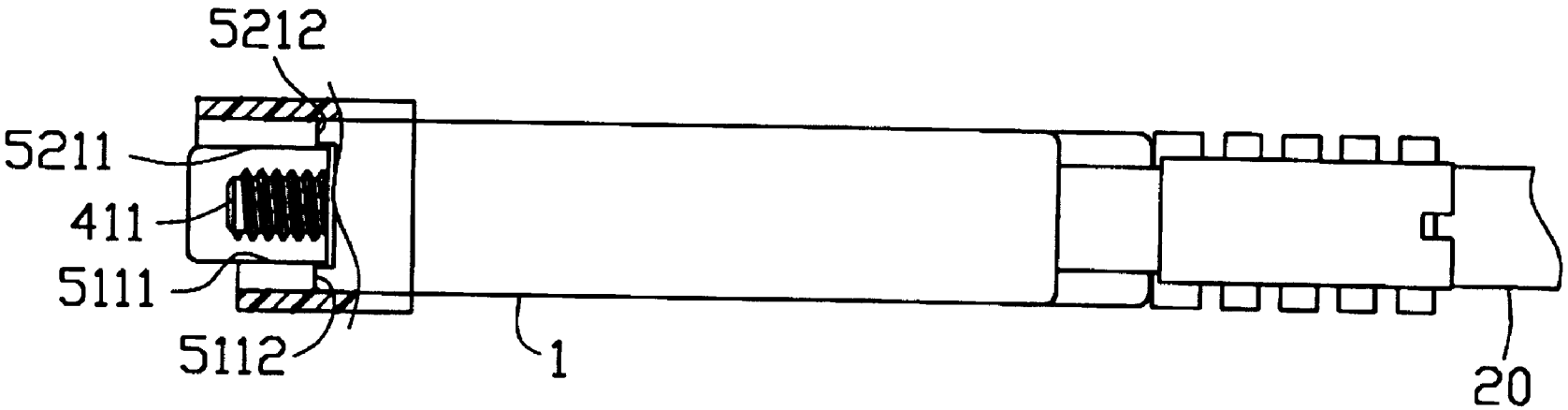
FIG. 3 is a partial sectional side view of FIG. 2 taken at line 3—3.
Figure 4:
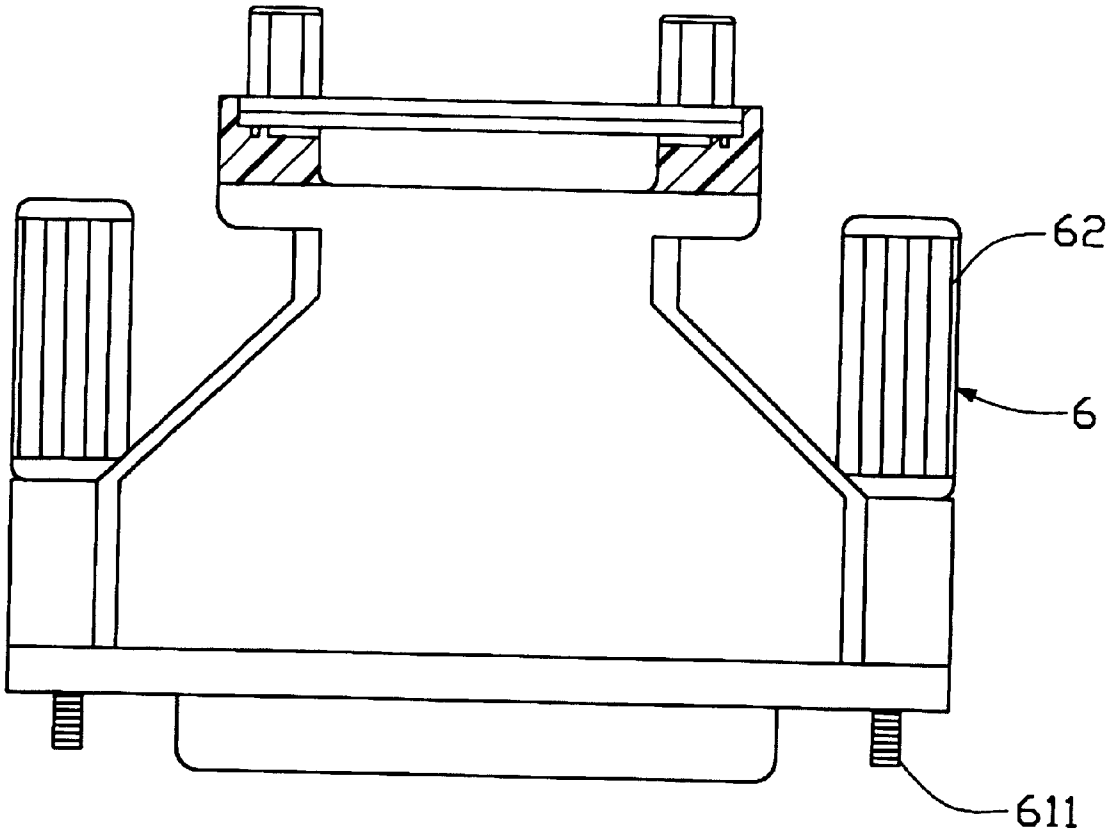
FIG. 4 (PRIOR ART)
FIG. 4 is a top view of a prior art cable connector.

Referring to FIGS. 1, 3, the elongate insulative shell 5 comprises a long top wall 52, a bottom wall 51 opposite the top wall 52 and two shorter side walls 53. The top wall 52 overhangs the bottom wall 51 and the two side walls 53 in a forward direction. Inner surfaces of the bottom and the top walls 51, 52 respectively form a row of abutments 511, 521 opposite one another and protruding into an interior of the insulative shell 5. Each abutment 511, 521 has a forward end flush with a front end 510, 520 of the bottom wall 51 or the top wall 52 from which it depends and extends rearward to its termination in substantially a middle portion of said wall. Each abutment 511, 521 defines an abutting surface 5111, 5211 respectively on a distal edge of the abutment for firmly engaging the metal shield 3, and a contacting face 5112, 5212 on a rearward side of each abutment 511, 521. A rear portion of the top wall 52, the bottom wall 51 and the sides walls 53 defines a mounting port 54 therebetween which is adapted to enclose a front end of the insulative housing 1, thereby securing the insulative shell 5 to the insulative housing 1.

Figure 2:
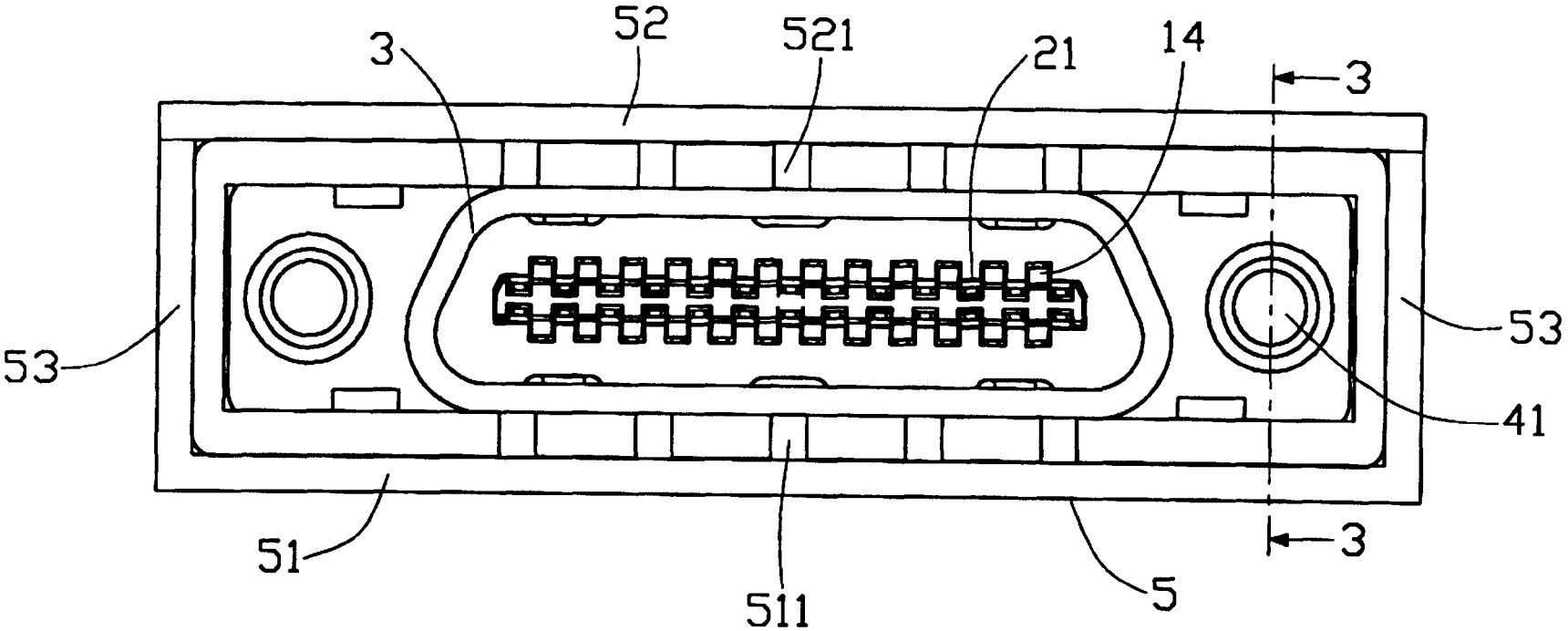
FIG. 2 is a front view of a cable connector of the present invention.

Referring to FIGS. 2, 3, in assembly, the plurality of contacts 2 are received in the insulative terminal housing 14, and the insulative terminal housing 14 is mounted in the insulative housing 1. The mounting portion of each contact 2 is connected to each of wires in the cable 20 which attaches at a rear end of the insulative housing 1. The mating face 11 with the metal shield 3 is fixed to the front end of the insulative housing 1, and the two positioning levers 4 are inserted through the holes (not labeled) in the insulative housing 1 at either side of the metal shield 3 so that the threaded periphery 411 of the retaining portion 41 thereof extends beyond the mating face 11 of the insulative housing 1. The insulative shell 5 is fitted to the front end of the insulative housing 1, the front end of the insulative housing 1 interferentially fitting into the mounting port 54 defined by the rear portion of the insulative shell 5, so that the abutting surfaces 5111, 5211 abut the metal shield 3 and the contacting faces 5112, 5212 at the rear side of each abutment abut a forward edge of the insulative housing 1. When mounted to the insulative housing 1, the insulative shell 5 encloses the retaining portion 41 of the positioning lever 4 and the metal shield 3, thereby guarding elements on a printed circuit board from accidental contact with the retaining portions 41 and the metal shield 3, protecting said elements from electrostatic discharge.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector, comprising:

an insulative housing having a mating face for mating with a mating connector;

a plurality of conductive contacts each comprising a mating portion;

an insulative terminal housing receiving the mating portions of the conductive contacts, the insulative terminal housing extending beyond the mating face of the insulative housing;

a metal shield enclosing the insulative terminal housing and depending forward from the mating face of the insulative housing;

a pair of positioning levers each having a retaining portion at one end thereof and a handle at an opposite end thereof and extending through a pair of holes defined in opposite sides of the insulative housing at either side of the metal shield; and an insulative shell being fitted on the metal shield and enclosing a frontal portion of the insulative housing and the two retaining portions of the pair of positioning levers for protecting electronic elements located near the cable connector from being damaged by an electrostatic discharge of static electricity collected on the metal shield and the positioning levers wherein the retaining portion of each positioning lever forms a threaded periphery at a distal end thereof extending beyond the mating face of the insulative housing;

wherein the insulative shell is substantially rectangular in shape and comprises an elongate top wall, a bottom wall opposite the top wall and two opposite side walls;

wherein the elongate top wall of the insulative shell overhangs the bottom wall and the two opposite side walls of the insulative shell in a forward direction;

wherein the top and the bottom walls each define a row of abutments formed on an inner surface of said wall and a front end, the abutments protruding into an interior of the insulative shell and extending rearward from the front ends to substantially middle portions of the top and the bottom walls;

wherein each of the abutments forms a contacting face which abuts a forward edge of the insulative housing and an abutting surface on a distal edge thereof for firmly engaging with the metal shield;

wherein a rear portion of the top wall, the bottom wall and the opposite side walls define a mounting port to enclose a front end of the insulative housing.

* * * * *